US008047716B2

(12) United States Patent
Ishizaka et al.

(10) Patent No.: US 8,047,716 B2
(45) Date of Patent: Nov. 1, 2011

(54) BRANCH TYPE STANDING POUCH

(75) Inventors: Koichi Ishizaka, Yokohama (JP); Kazumi Ozawa, Yokohama (JP); Takayuki Aikawa, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 471 days.

(21) Appl. No.: 12/377,517

(22) PCT Filed: Aug. 14, 2007

(86) PCT No.: PCT/JP2007/065849

§ 371 (c)(1),
(2), (4) Date: Feb. 13, 2009

(87) PCT Pub. No.: WO2008/020590

PCT Pub. Date: Feb. 21, 2008

(65) Prior Publication Data

US 2010/0278459 A1 Nov. 4, 2010

(30) Foreign Application Priority Data

Aug. 16, 2006 (JP) ..... 2006-221897

(51) Int. Cl.

| | |
|---|---|
| ***B65D 30/16*** | (2006.01) |
| ***B65D 33/00*** | (2006.01) |
| ***B65D 33/02*** | (2006.01) |
| ***B65D 37/00*** | (2006.01) |
| ***B65D 35/00*** | (2006.01) |

(52) U.S. Cl. ..... 383/104; 383/105; 383/119; 383/906; 222/92; 222/107

(58) Field of Classification Search ..... 383/104, 383/105, 66, 119, 906; 222/92, 107, 206, 222/544, 545, 547, 566, 572, 573
See application file for complete search history.

(56) References Cited

U.S. PATENT DOCUMENTS

| | | | | |
|---|---|---|---|---|
| 4,717,046 | A | 1/1988 | Brogli | |
| 6,641,307 | B2 * | 11/2003 | Matsuda et al. | 383/38 |
| 6,667,081 | B1 * | 12/2003 | Aoki et al. | 428/34.1 |
| 2005/0087456 | A1 * | 4/2005 | Oka et al. | 206/219 |
| 2006/0072858 | A1 * | 4/2006 | Kurosawa et al. | 383/44 |

FOREIGN PATENT DOCUMENTS

CH 677092 A5 * 4/1991

(Continued)

*Primary Examiner* — Nathan J Newhouse
*Assistant Examiner* — Latrice Byrd
(74) *Attorney, Agent, or Firm* — Sughrue Mion, PLLC

(57) ABSTRACT

A branch type standing pouch which includes a pouch front side member including a pouring-out nozzle backside portion which constitutes a backside of a pouring-out nozzle by being folded back and a pouch body front side portion continuous therewith; a pouch backside member constituting a backside of the pouch body; a pouring-out nozzle front side member; and a bottom member. The pouch front side member, the pouch backside member, the pouring-out nozzle front side member, and the bottom member are respectively formed of plastic film and heat-sealed to each other so that a pouring-out nozzle is formed in a branched manner from a top of a pouch body. In this pouch, two symmetrical nozzle reinforcing areas are formed on both sides of a first protrusion as a result of a provision of the first to fourth protrusions. As a result, the branch type standing pouch in which the pouring-out nozzle can be fixed upright at a time of opening is obtained.

8 Claims, 11 Drawing Sheets

FOREIGN PATENT DOCUMENTS

| | | | | |
|---|---|---|---|---|
| EP | 0 209 739 | A2 | | 6/1986 |
| GB | 2278338 | A | | 11/1994 |
| JP | 05-132069 | A | | 5/1993 |
| JP | 06001358 | A | * | 1/1994 |
| JP | 10-129683 | A | | 5/1998 |
| JP | 11-59704 | A | | 3/1999 |
| JP | 11-314652 | A | | 11/1999 |
| JP | 11-321886 | A | | 11/1999 |
| JP | 2003-137319 | A | | 5/2003 |
| JP | 2005-313994 | A | | 11/2005 |

* cited by examiner

BRANCH TYPE STANDING POUCH

TECHNICAL FIELD

The present invention relates to a branch type standing pouch in which a nozzle portion for taking out contents such as seasoning, cosmetics, or detergent filled in the pouch is provided in a branched manner from a top of a pouch body, and the nozzle can be fixed upright at the time of opening.

BACKGROUND ART

Conventionally, there has been known a refill pouch which is sealed after filling contents such as seasoning, cosmetics, or detergent therein. The refill pouch is designed to transfer the contents into a plastic bottle, a glass bottle, or other containers after being opened. Thus, the refill pouch as described above is demanded to allow the contents to be easily taken out while maintaining stable flow to the end.

Well-known examples of the refill pouch include one in which a nozzle portion formed of a member which is separated from a pouch body is formed at a corner portion of a pouch (refer to Patent Document 1). Further, there is proposed one in which a nozzle portion is formed by processing a wrapping member which constitutes a pouch main body (refer to Patent Document 2).

In addition, there is known a standing pouch in which a nozzle portion is formed with an opening and fold lines at the central portion of the upper end of the pouch (refer to Patent Document 3).

Patent Document 1: JP 5-132069 A
Patent Document 2: JP 2003-137319 A
Patent Document 3: JP 10-129683 A However, in the refill pouch having the nozzle portion formed at the corner portion of the pouch, when contents of high viscosity are poured out, the nozzle is blocked owing to pressurization, with the result that it is difficult to pour out the contents of high viscosity in some cases. In addition, when the pouch is rolled up from the bottom portion thereof for the purpose of squeezing out the contents of a small remaining amount, the pouch is diagonally rolled up. As a result, there is a disadvantage in that the contents are accumulated on the upper side of the pouch, which is difficult to be rolled up, and hence the remaining amount thereof is increased.

In addition, regarding the pouch having the nozzle portion formed of the separated member, special members and processes are necessary, and hence manufacturing cost of the pouch is increased. Further, the pouch prior to filling of contents is space-consuming, and hence there is a problem of an increase in transportation cost.

Meanwhile, in the pouch disclosed in Patent Document 3, in which the nozzle portion is formed of the opening and the fold lines at the central portion of the upper end of the pouch, when the pouch is squeezed for pouring out the contents thereof, the contents are spilt in some cases owing to unstable configuration of the nozzle portion. Further, there is a disadvantage in that the nozzle portion is blocked so that it is difficult to pour out the contents.

In the past, in order to solve those problems in the related art, the inventors of the present invention have proposed a branch type standing pouch in which, at the center of the nozzle portion formed from the top of the standing pouch body in a branched manner, there are provided mountain-fold ridge lines extending in the longitudinal direction, and nozzle base forming lines on both the sides thereof (Patent Document 4).

Patent Document 4: JP 2005-313994 A

In this standing pouch, the pouch is opened and the squeezing portions on both the upper sides of the pouch are squeezed, whereby a three-dimensional nozzle having a large bore diameter can be formed with a single touch. Further, the configuration of the nozzle of the pouch is stable, and hence it is possible to easily operate the pouch with one hand so as to swiftly and completely pour out the contents. In addition, the entire shape the pouch is stable, and hence the outward appearance is excellent when the pouch is opened and the nozzle is formed.

However, as illustrated in FIG. 4 of Patent Document 4, this pouch is used by squeezing the squeezing portions on both the upper sides of the pouch so as to stand the nozzle diagonally upward. Thus, the operation of pouring out the contents, which is performed by children with small hands, weak women, and old persons, is unstable in some cases. Further, the nozzle is divided at the branch portion, and hence there is a problem that it is difficult to stand the nozzle in a three-dimensional manner and maintain the opened state thereof in some cases. Therefore, a branch type standing pouch has been demanded, in which the opened nozzle can easily be stood to be fixed, and in addition, which can easily be operated for pouring-out.

DISCLOSURE OF THE INVENTION

Problem to be Solved by the Invention

It is an object of the present invention to provide a branch type standing pouch in which an opened nozzle can easily be stood, and in addition, the opened nozzle can be stably maintained so that contents thereof can easily be poured out.

Means for Solving the Problem

In order to achieve the above-mentioned object, the present invention adopts the following constitutions described in items 1 to 8.

1. A branch type standing pouch, comprising:

a pouch front side member including a pouring-out nozzle backside portion which constitutes a backside of a pouring-out nozzle by being folded back and a pouch body front side portion continuous therewith;

a pouch backside member constituting a backside of the pouch body;

a pouring-out nozzle front side member; and a bottom member, wherein:

the pouch front side member, the pouch backside member, the pouring-out nozzle front side member, and the bottom member being respectively formed of plastic film and heat-sealed to each other so that a pouring-out nozzle is formed in a branched manner from a top of a pouch body, wherein:

two symmetrical nozzle reinforcing areas are formed on both sides of a first protrusion as a result of a provision of the first protrusion at a central upper portion of the pouch front side member, extending from a center of the pouring-out nozzle backside portion to a central upper portion of the pouch body front side portion beyond a fold-back portion, and of a provision of two symmetrical second protrusions on both the sides of the first protrusion;

a third protrusion extending in a longitudinal direction of the nozzle is provided at a center of the pouring-out nozzle front side member; and a fourth protrusion is provided on an extension line from the third protrusion at a central upper portion of the pouch backside member, whereby the pouring-out nozzle can be fixed upright at a time of opening.

2. A branch type standing pouch according to the item 1, wherein a portion serving as a preformed opening line is provided at a leading end of the branched nozzle, the portion being subjected to processing for facilitating opening.

3. A branch type standing pouch according to the item 1 or 2, wherein, when the pouring-out nozzle is opened, lower ends of the first protrusion and the fourth protrusion reach at least an upper end surface of contents in the pouch.

4. A branch type standing pouch according to any one of the items 1 to 3, wherein the nozzle reinforcing areas formed on the pouch front side member have triangular shapes which have apexes on the fold-back portion.

5. A branch type standing pouch according to any one of the items 1 to 3, wherein the nozzle reinforcing areas formed on the pouch front side member have crescent shapes which have a maximum width at the fold-back portion.

6. A branch type standing pouch according to any one of the items 1 to 5, wherein a height of a cross-section of each of the first protrusion, the second protrusions, the third protrusion, and the fourth protrusion is set to 0.5 to 5 mm, and a width thereof is set to 1 to 30 mm.

7. A branch type standing pouch according to any one of the items 1 to 6, wherein auxiliary protrusions are provided below the nozzle reinforcing areas formed on the pouch front side member.

8. A branch type standing pouch according to any one of the items 1 to 7, wherein an upper portion of the pouch body is narrowed so that squeezing portions are formed on both peripheral portions of the upper portion of the pouch body.

EFFECTS OF THE INVENTION

The branch type standing pouch of the present invention has the following remarkable effects.

(1) A three-dimensional nozzle having a large bore diameter can be formed with a single touch in which the leading end of the opened nozzle is merely pulled up after opening the pouch.

(2) The nozzle is fixed in an upright state, and hence it is possible to easily pour out the contents thereof regardless of the held portions of the pouch, and to swiftly and completely pour out even the contents of high viscosity.

(3) The entire shape of the pouch is stable, and hence the outward appearance is excellent when the nozzle is formed.

(4) The pouch can be manufactured at low cost with use of the conventional facilities without necessity of special members or processes.

(5) The transportation cost of the pouch can be suppressed owing to a compact size thereof prior to filling of contents, and the pouch after use can easily be disposed of.

DESCRIPTION OF REFERENCE NUMERALS

Figure 1:
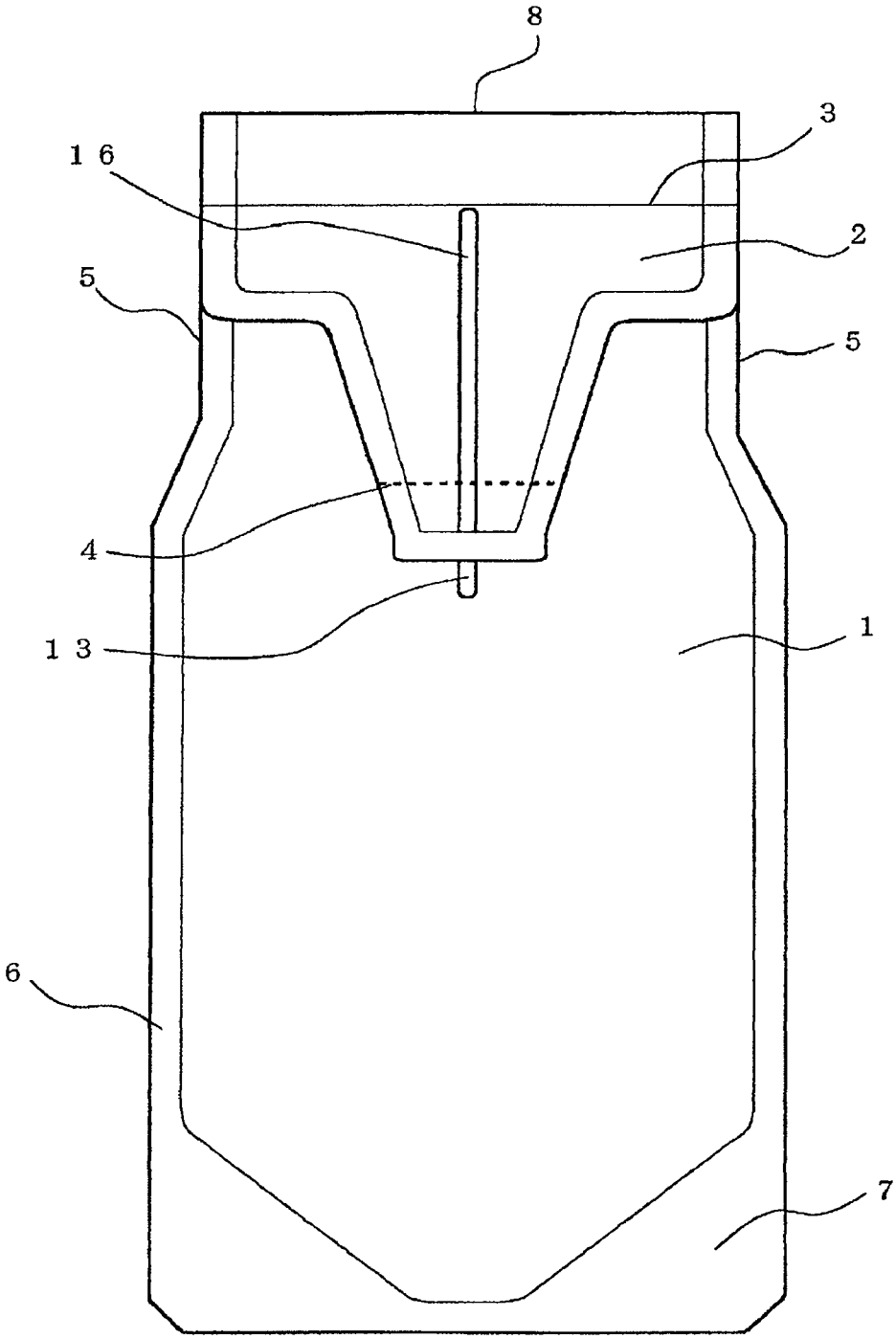
FIG. 1 A view illustrating an example of a branch type standing pouch of the present invention, and a front view of the pouch in which contents are not filled.

1 pouch body
2 nozzle
3 fold-back portion
4 preformed opening line
5 squeezing portion
6 peripheral sealed portion
7 bottom sealed portion
8 filling inlet
11 pouch body front side portion
12 pouring-out nozzle backside portion
13 first protrusion
14 second protrusion
15 reinforcing area
16 third protrusion
17 fourth protrusion
18 auxiliary protrusion
21 pouch front side member
22 pouch backside member
23 pouring-out nozzle front side member
24 bottom member

BEST MODE FOR CARRYING OUT THE INVENTION

The branched standing pouch of the present invention is constituted by heat-sealing the plastic film and the material for the plastic film used in the pouch is not particularly limited.

Examples of the plastic material suitable to constitute the plastic film include: polyolefins such as a crystalline polypropylene, a crystalline propylene-ethylene copolymer, a crystalline polybutene-1, a crystalline poly 4-methylpentene-1, a low-, middle-, high-density polyethylene, an ethylene-vinyl acetate copolymer (EVA), an ethylene-ethylacrylate copolymer (EEA), and ion cross-linked olefin copolymer (ionomer); aromatic vinyl copolymers such as a polystyrene and a styrene-butadiene copolymer; halogenated vinyl polymers such as a polyvinyl chloride and a vinylidene chloride resin; nitrile polymers such as an acrylonitrile-styrene copolymer and an acrylonitrile-styrene-butadiene copolymer; polyamides such as a nylon 6, a nylon 66, a para- and metha-xylene adipamide; polyesters such as a polyethylene terephthalate and a polytetramethylene terephthalate; various polycarbonates; and thermoplastic resins formed of polyacetals such as a polyoxymethylene.

The plastic films formed of those materials may be used as unstretched, uniaxially stretched, or biaxially stretched films.

The plastic film used in the standing pouch of the present invention is used as a single layer of the plastic film or used by laminating two or more kinds of the plastic films. In addition, the plastic films used in the standing pouch of the present invention may be used by laminating one kind or two or more kinds of the plastic films with a metal foil such as aluminum foil, paper, or cellophane.

Examples of the preferable plastic film include: a two-layered film having a stretched nylon film as an outer layer, a polyolefin film such as a low-density polyethylene or a polypropylene as an inner layer; a two-layered film having a stretched polyester film as an outer layer and a polyolefin film as an inner layer; and a three-layered film obtained by laminating a metal foil such as aluminum foil between the inner and outer layers. Upon the production of those laminated films, an adhesive or an anchor agent may be interposed between each layer, as required.

The layer structure of the above-mentioned plastic film is selected in accordance with properties of the contents filled in the standing pouch. For example, when cost reduction is required as in the case of a standing pouch for refillable detergent, there is used a single layer film or a laminated film of a double layer structure. Further, when preservability is required as in the case of a standing pouch for seasoning, it is preferable to use a laminated film of a triple (or more) layer structure including an aluminum foil.

Next, the branch type standing pouch of the present invention is described with reference to the figures.

Figure 2:
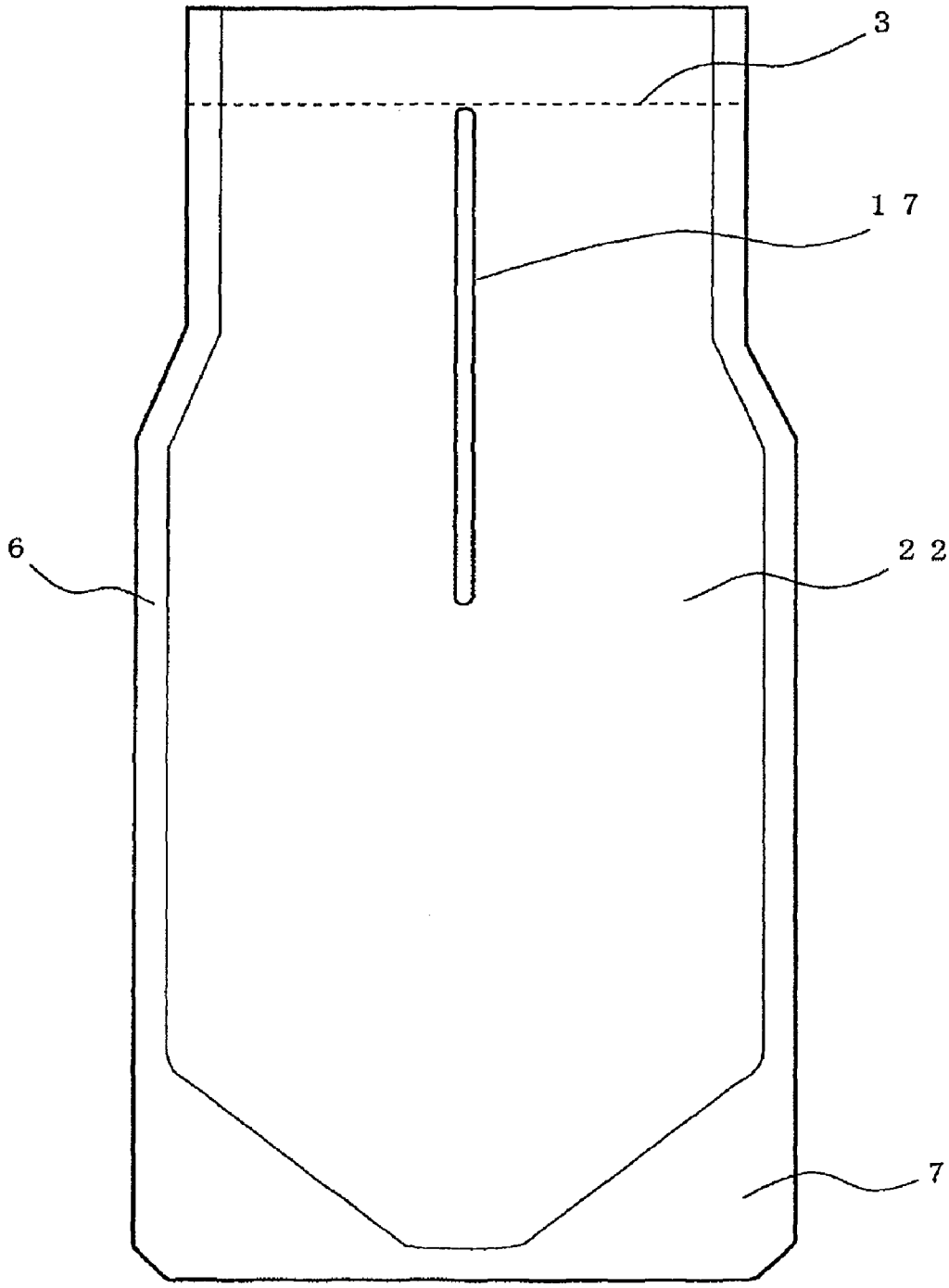
FIG. 2 A rear view of the pouch of FIG. 1.
Figure 3A:
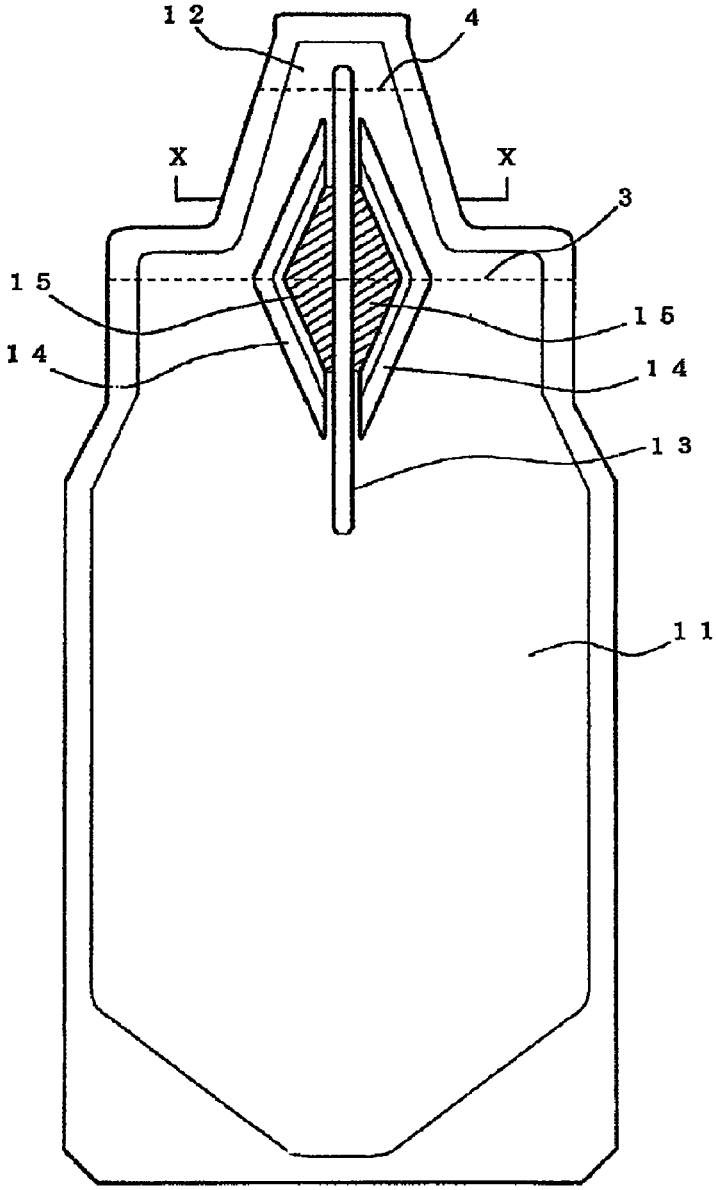
FIG. 3 Portion (A) is a front view illustrating a state in which a nozzle portion of the pouch of FIG. 1 is raised upward, and Portion (B) is an enlarged schematic sectional view taken along the line X-X of Portion (A).
Figure 3B:
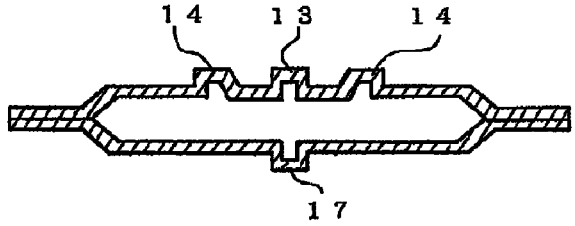
Figure 4:
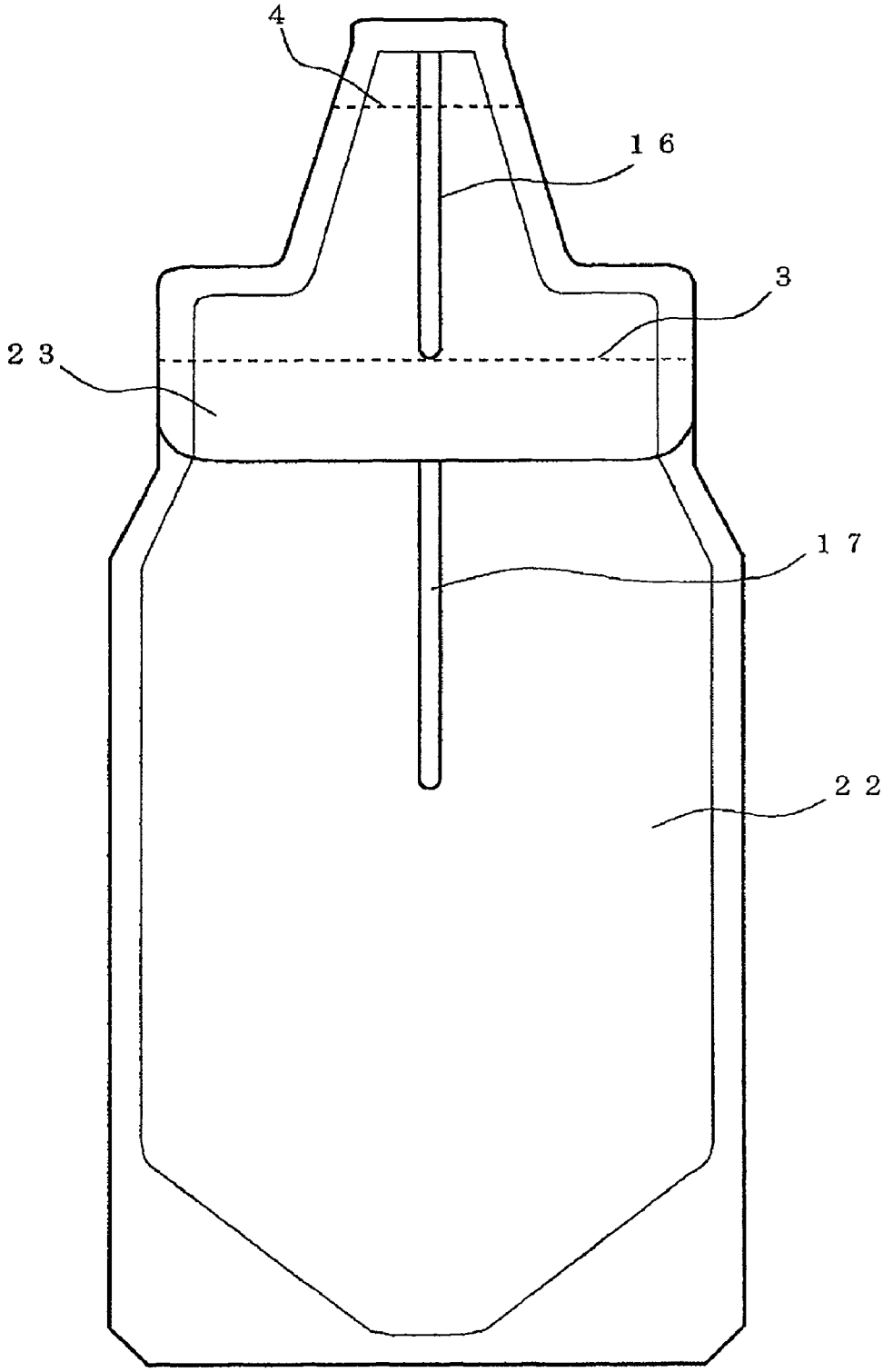
FIG. 4 A rear view of the pouch of FIG. 3.
Figure 5A:
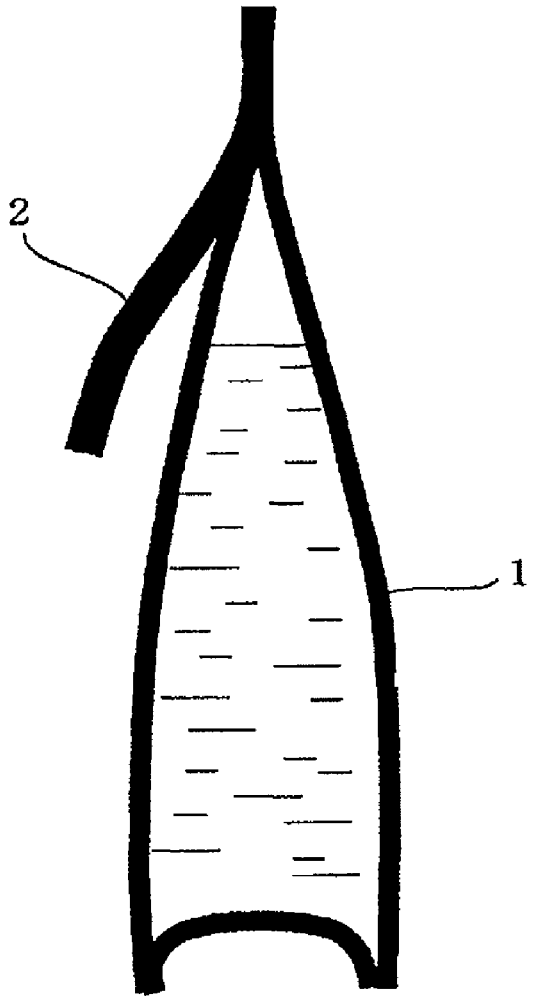
FIG. 5 A schematic view illustrating how the pouring-out nozzle is formed when the pouch of FIG. 1 is opened to be used.
Figure 5B:
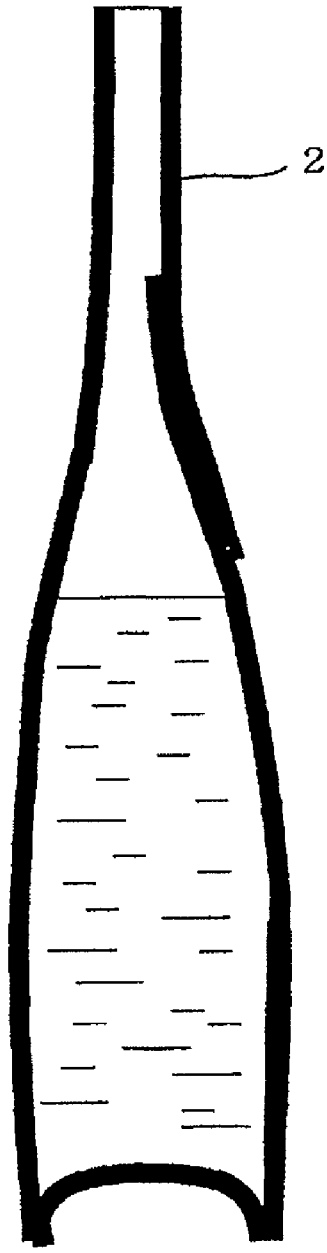
Figure 6:
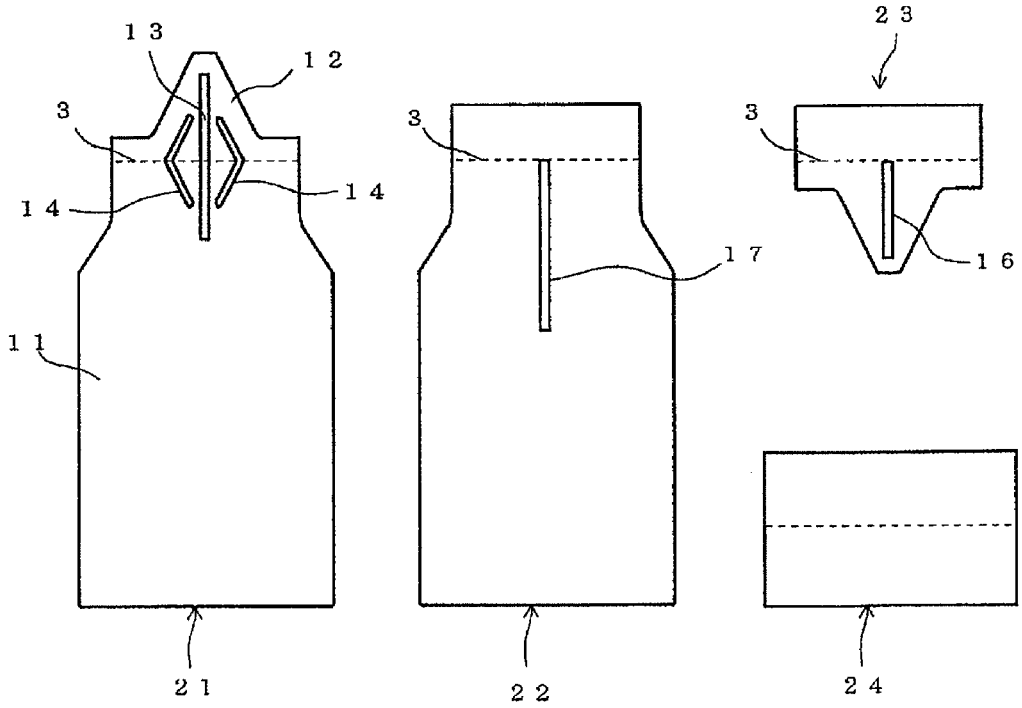
FIG. 6 A schematic view of members constituting the pouch of FIG. 1.

FIGS. 1 to 6 illustrate an example of the branch type standing pouch of the present invention. FIG. 1 is a front view of the pouch in which contents are not filled. FIG. 2 is a rear view of the pouch of FIG. 1. Portion (A) of FIG. 3 is a front view illustrating a state in which a nozzle portion of the pouch of FIG. 1 is raised upward, and Portion (B) of FIG. 3 is an enlarged sectional view taken along the line X-X of Portion (A) of FIG. 3. FIG. 4 is a rear view of the pouch of FIG. 3. FIG. 5 is a schematic view illustrating how the pouring-out nozzle is formed when the pouch is opened to be used, in which Portion (A) is a schematic sectional view of the still-sealed pouch with the contents filled therein, and Portion (B) is a schematic sectional view illustrating a state in which the pouch is opened so as to form a pouring-out nozzle. FIG. 6 is a schematic view of members constituting the pouch.

The standing pouch is provided with a pouring-out nozzle 2 from the top of a pouch body 1 in a branched manner, the pouring-out nozzle 2 being foldable back by 180° from a fold-back portion 3 to the upper portion of the pouch. In addition, the leading end of the pouring-out nozzle 2 is subjected to processing for facilitating opening, such as perforating, score processing, or laser processing along a preformed opening line 4. Note that, the preformed opening line 4 may be formed straight or in a curved manner.

In the upper portion of the pouch body, there is provided squeezing portions 5 and 5 which are formed to be narrower than the trunk portion so as to be squeezed from both sides thereof with the thumb and index finger of the hand when the pouch is opened for pouring out the contents thereof. The peripheral portions of the pouch body 1 and the pouring-out nozzle 2 are heat-sealed to each other so as to form a peripheral sealed portion 6 and a bottom sealed portion 7. In addition, an opened filling inlet 8 is provided at the upper edge portion of the pouch, the filling inlet 8 being heat-sealed after contents are filled therein.

This standing pouch is constituted by heat-sealing to each other the peripheral portions of the following materials illustrated in FIG. 6: a pouch front side member 21 including a pouring-out nozzle backside portion 12 which constitutes a backside of the pouring-out nozzle 2 by being folded back from the fold-back portion 3 and including a pouch body front side portion 11 continuous therewith; a pouch backside member 22 constituting a backside of the pouch body; a pouring-out nozzle front side member 23 constituting a pouring-out nozzle front side; and a bottom member 24 constituting a pouch bottom portion by being folded into two.

At the center of the pouring-out nozzle backside portion of the pouch front side member 21, when the pouch is opened from the preformed opening line 4 so as to form the nozzle 2 of a quadrangular cross-section, a first protrusion 13 serving as one ridge line of the nozzle is formed from substantially the entire length in the longitudinal direction of the nozzle 2 to the upper portion of the pouch body front side portion 11 beyond the fold-back portion 3. In addition, the other end of the first protrusion 13 intersects with the preformed opening line 4 at the nozzle leading end so that, when the nozzle leading end is opened, the first protrusion 13 reaches the opening end.

On both sides of the first protrusion 13, there are provided two symmetrical second protrusions 14 and 14 which respectively have a dogleg shape and a reverse dogleg shape, whereby two symmetrical nozzle reinforcing areas 15 and 15, which have isosceles triangular shapes and apexes on the fold-back portion 3, are formed on both the sides of the first protrusion 13 (refer to FIG. 3). At the center of the pouring-out nozzle front side member 23, there is formed a third protrusion 16 extending in the longitudinal direction of the nozzle 2. In the upper portion of the center of the pouch backside member 22, there is provided a fourth protrusion 17 on the extension line from the third protrusion 16 (refer to FIG. 6).

In this standing pouch, when the contents thereof are poured out, the nozzle 2 is opened from the preformed opening line 4 provided at the leading end of the nozzle 2. Next, the leading end of the nozzle 2 is pinched and pulled up by the thumb and index finger of the hand, whereby the nozzle 2 can easily be stood upright. In addition, owing to the two symmetrical nozzle reinforcing areas 15 and 15 provided on both the sides of the first protrusion 13, the nozzle 2 is fixedly supported from both the sides thereof so as to be stably fixed in an upright state. Thus, when the contents are poured out from the opened nozzle 2, even in the case of holding the pouch at portions other than the squeezing portions 5 in the upper portion of the pouch, the contents thereof can be poured out without any troubles. As a result, the contents of high viscosity can be poured out swiftly and completely from the pouch even by children with small hands, weak women, and old persons.

It is preferable that the lower ends of the first protrusion 13 formed on the front side of the pouch and of the fourth protrusion 17 formed on the backside reach, when the pouch filled with contents is opened so that the nozzle 2 is stood upright, at least the upper end surface of the contents (liquid level in the case of liquid contents), or more preferably, be positioned below the upper end surface of the contents. With this configuration, it is possible to more stably fix the nozzle 2 in a state of being opened and stood upright.

Figure 7:
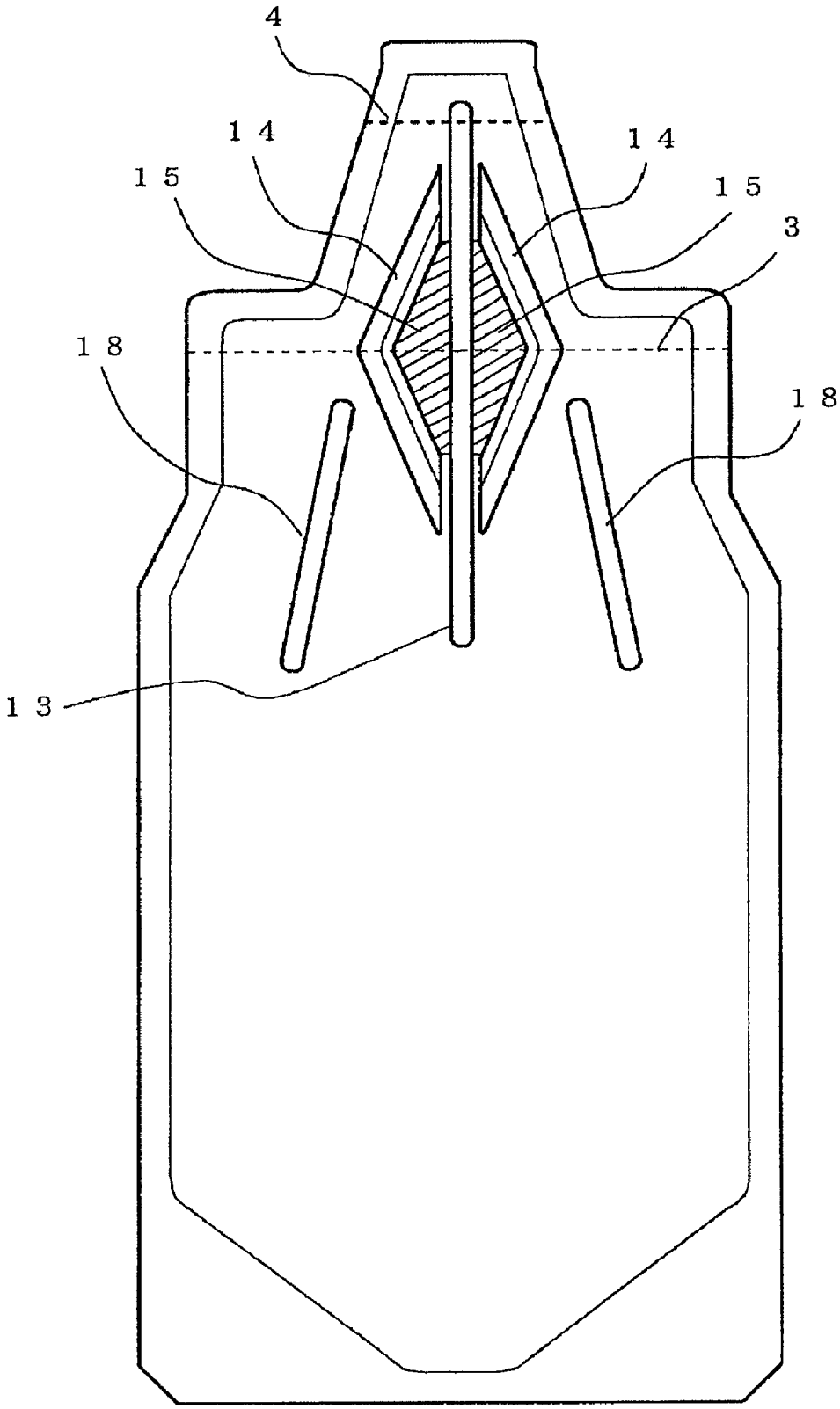
FIG. 7 A view illustrating another example of a branch type standing pouch of the present invention, and a front view of the pouch in which contents are not filled.

FIG. 7 illustrates a pouch front side member 21 constituting another example of the branch type standing pouch of the present invention.

In this example, below the nozzle reinforcing areas 15 and 15 formed on the pouch front side member 21 of FIG. 3, there are provided auxiliary protrusions 18 and 18 symmetrically on both the sides of the first protrusion 13. Otherwise, the structure of the pouch is the same as that of the pouch illustrated in FIGS. 1 to 6.

Figure 8:
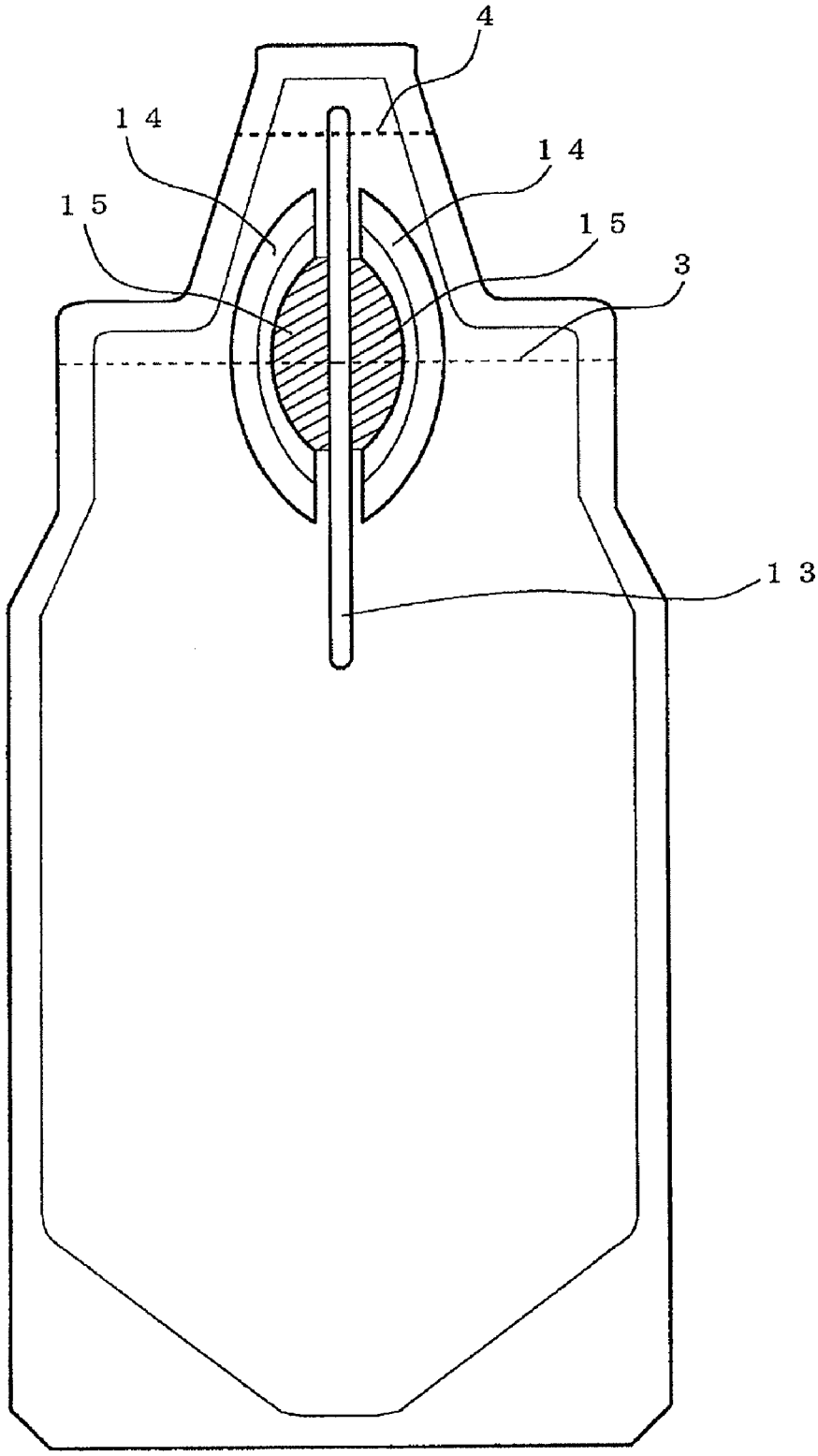
FIG. 8 A view illustrating another example of a branch type standing pouch of the present invention, and a front view of the pouch in which contents are not filled.

FIG. 8 illustrates a pouch front side member 21 constituting another example of the branch type standing pouch of the present invention.

In this example, the nozzle reinforcing areas 15 and 15 formed on the pouch front side member 21 have crescent shapes in which the widths thereof are maximized at the fold-back portion 3. Otherwise, the structure of the pouch is the same as that of the pouch illustrated in FIGS. 1 to 6.

Figure 9:
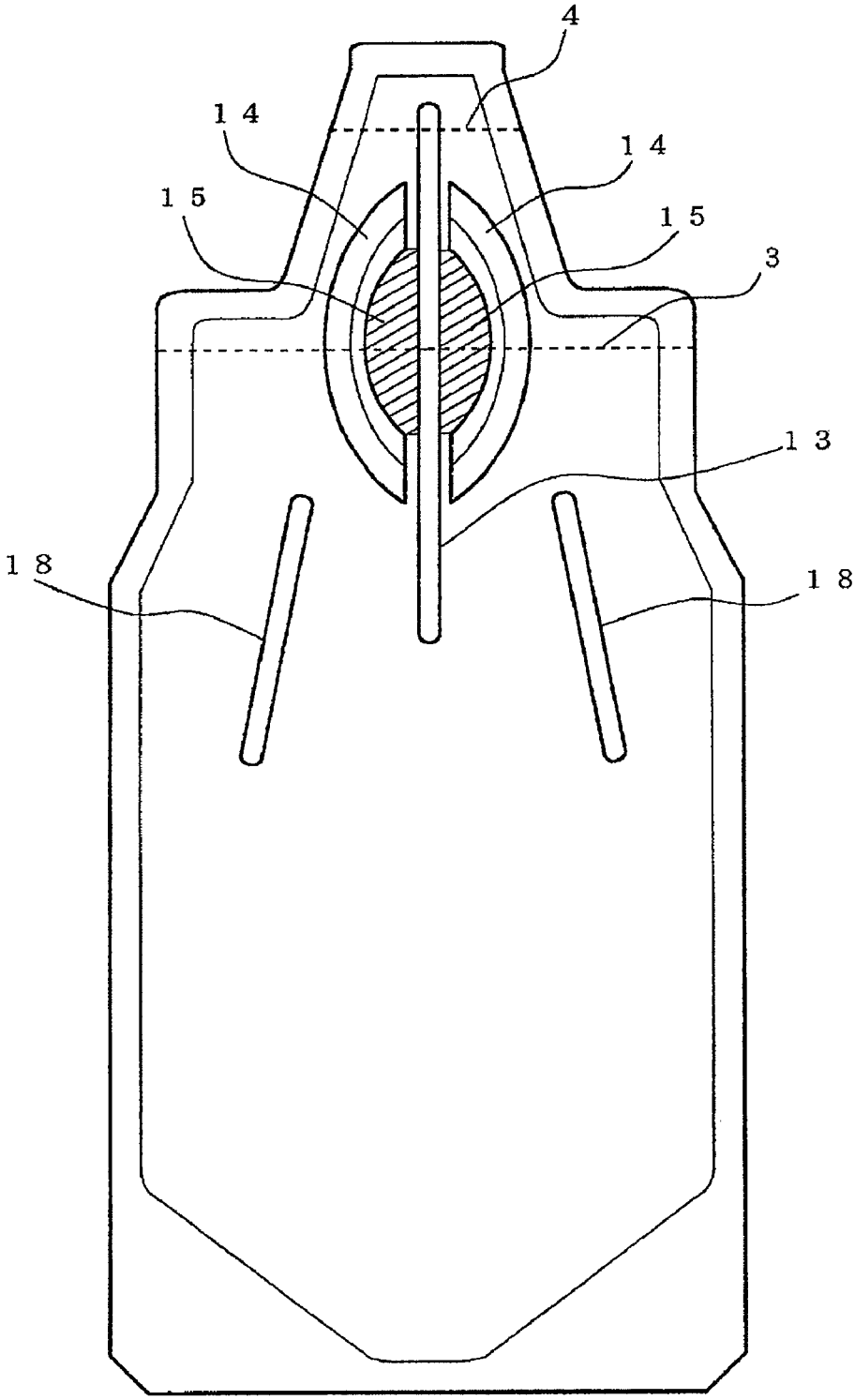
FIG. 9 A view illustrating another example of a branch type standing pouch of the present invention, and a front view of the pouch in which contents are not filled.

FIG. 9 illustrates a pouch front side member 21 constituting another example of the branch type standing pouch of the present invention.

In this example, below the nozzle reinforcing areas 15 and 15 formed on the pouch front side member 21 of FIG. 8, there are provided auxiliary protrusions 18 and 18 symmetrically on both the sides of the first protrusion 13. Otherwise, the structure of the pouch is the same as that of the pouch illustrated in FIG. 8.

Figure 10:
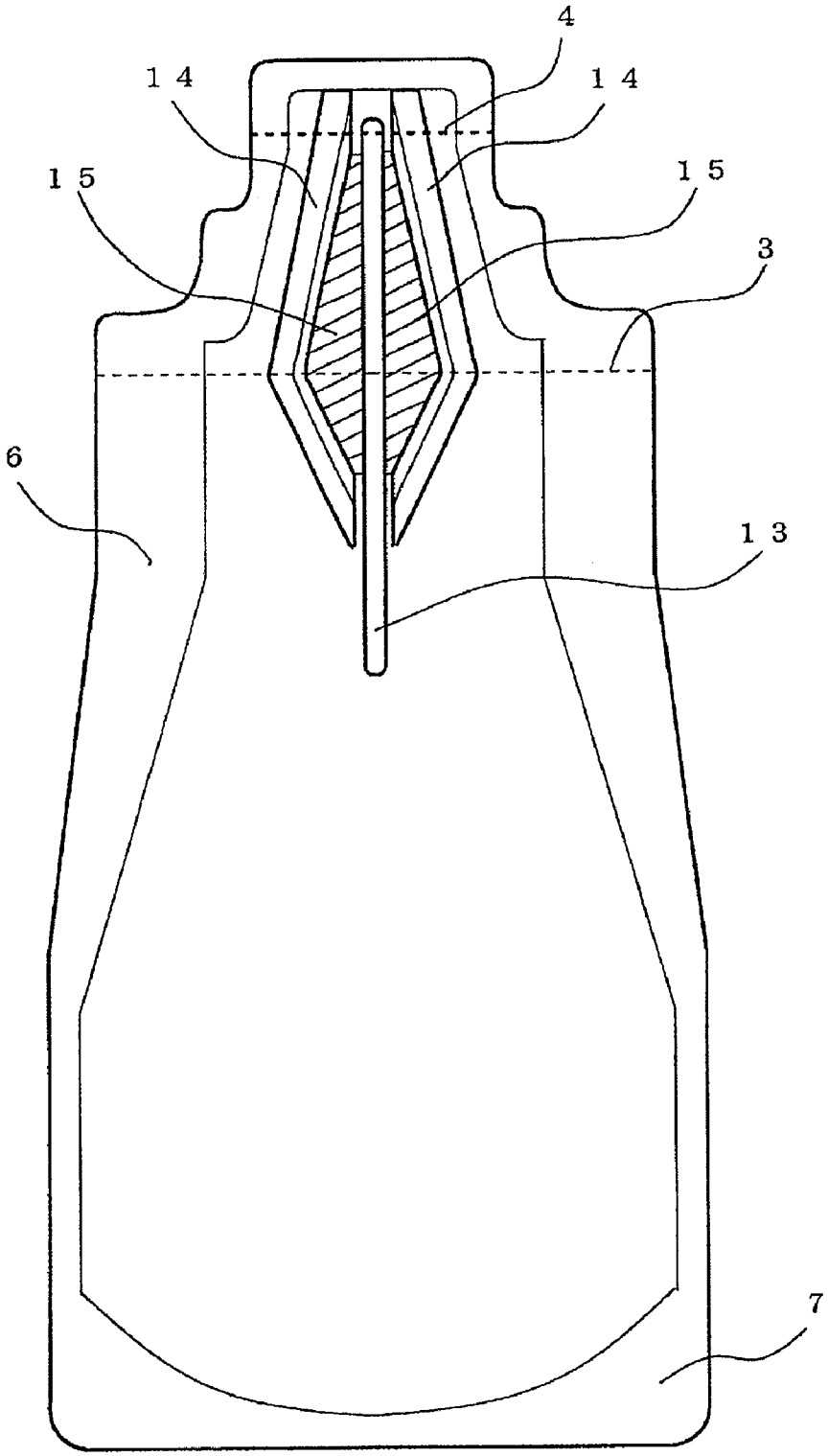
FIG. 10 A view illustrating another example of a branch type standing pouch of the present invention, and a front view of the pouch in which contents are not filled.

FIG. 10 illustrates a pouch front side member 21 constituting another example of the branch type standing pouch of the present invention.

In this example, the nozzle reinforcing areas 15 and 15 formed on the pouch front side member 21 have inequilateral triangular shapes which have the apexes thereof positioned on the fold-back portion 3 and are gently inclined to the nozzle leading end. The upper end of the second protrusions 14 on the nozzle leading end side intersect with the preformed opening line 4 at the nozzle leading end so that, when the nozzle leading end is opened, the second protrusions 14 reach the opening end. The configurations of the upper portion of the pouch body 1 and the peripheral sealed portion 6 of the nozzle 2 are modified so that the outer configurations of both sides of the leading end of the nozzle 2 are parallel to each other. Otherwise, the structure of the pouch is basically the same as that of the pouch illustrated in FIGS. 1 to 6.

Figure 11:
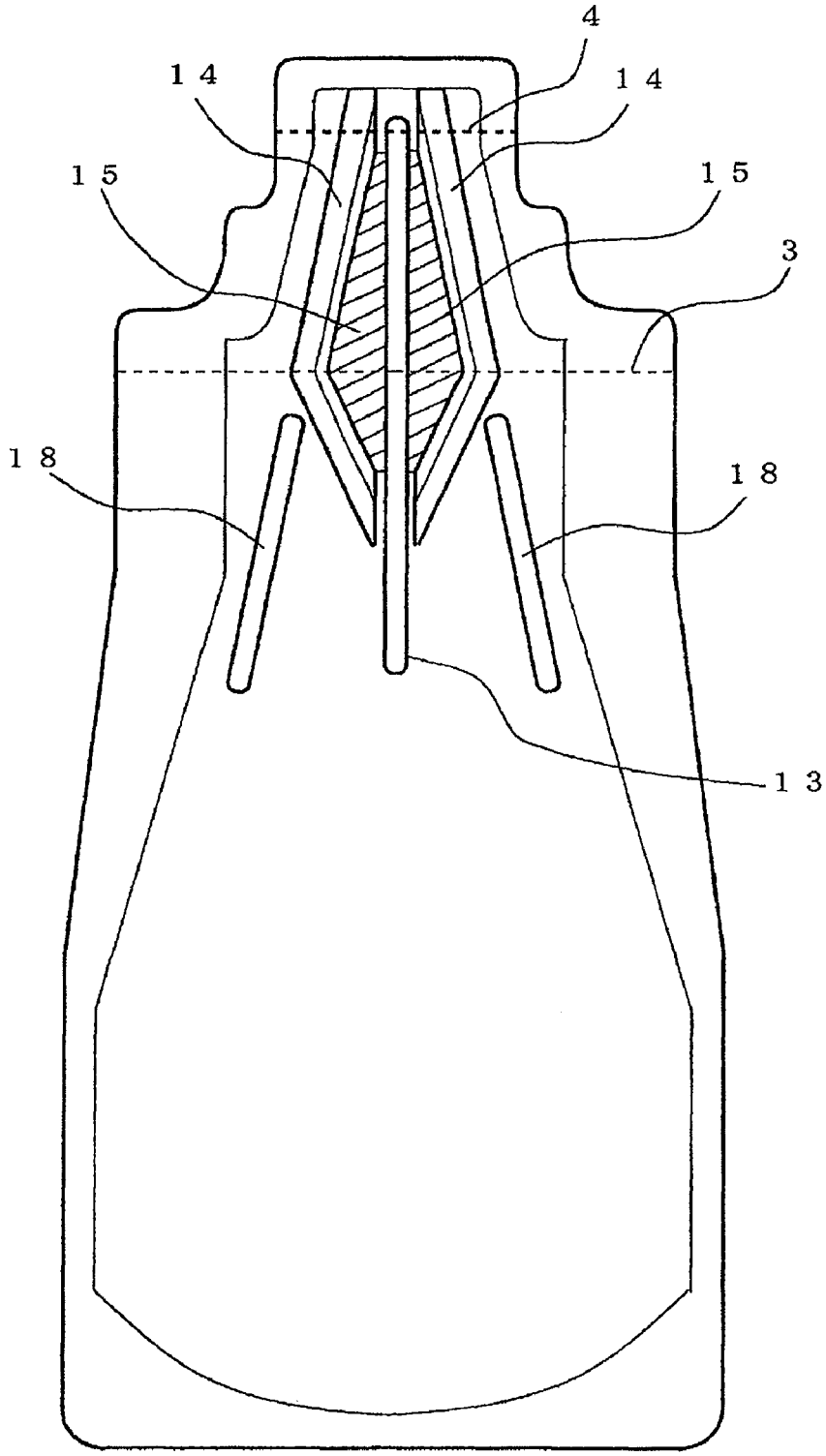
FIG. 11 A view illustrating another example of a branch type standing pouch of the present invention, and a front view of the pouch in which contents are not filled.

FIG. 11 illustrates a pouch front side member 21 constituting another example of the branch type standing pouch of the present invention.

In this example, below the nozzle reinforcing areas 15 and 15 formed on the pouch front side member 21 of FIG. 10, there are provided auxiliary protrusions 18 and 18 symmetrically on both the sides of the first protrusion 13. Otherwise, the structure of the pouch is the same as that of the pouch illustrated in FIG. 10.

In the above-mentioned embodiments, it is preferable that the first protrusion 13, the second protrusions 14, the third protrusion 16, the fourth protrusion 17, and the auxiliary protrusions 18 be respectively formed on the pouch front side member 21, the pouch backside member 22, and the pouring-out nozzle front side member 23 by embossing or the like in advance.

The sectional configurations of the protrusions can be appropriately selected. As illustrated in Portion (B) of FIG. 3, in the above-mentioned embodiments, the second protrusions 14 have trapezoidal shapes which have inclined portion provided therein, and the other protrusions have quadrangular sectional configurations. In addition, while the dimensions of the respective protrusions are arbitrary, normally, it is preferable that the heights of the cross-sections be set to approximately 0.5 to 5 mm, and the widths thereof be set to approximately 1 to 30 mm.

Note that, it is needless to say that design variations such as that on the configuration of the nozzle reinforcing areas 15 and omitting of the narrow squeezing portions 5 from the upper portion of the pouch body can be appropriately made.

The branch type standing pouch of the present invention allows, at the time of pouring out contents of high viscosity, a nozzle portion having a large bore diameter, which involves small flow path resistance, to be stood upright and fixed so as to swiftly and completely take out the contents through a simple operation. Further, the branch type standing pouch of the present invention can be manufactured at low cost with use of normal manufacturing facilities without necessity of special members or processes. Still further, the pouch prior to filling of contents is not space-consuming so that transportation cost therefor can be saved. In addition, the pouch after use can easily be disposed of.

Note that, while the standing pouch is a mode of the pouch of the present invention, the formation of the nozzle portion of the present invention is also applicable to a flat pouch.

There is no particular limitation regarding the contents filled in the branch type standing pouch of the present invention. For example, the pouch can be used for filling contents of wide range, such as seasoning, food, drink, cosmetics, or detergent as in a form of powder or of liquid. In particular, the pouch is suitably used for filling contents such as shampoo, rinse, conditioner, hand-wash, body-wash, dressing, or cooking oil.

The invention claimed is:

1. A branch type standing pouch, comprising:

a pouch front side member including a pouring-out nozzle backside portion which constitutes a backside of a pouring-out nozzle by being folded back and a pouch body front side portion continuous therewith;

a pouch backside member constituting a backside of the pouch body;

a pouring-out nozzle front side member; and a bottom member, wherein:

the pouch front side member, the pouch backside member, the pouring-out nozzle front side member, and the bottom member being respectively formed of plastic film and heat-sealed to each other so that a pouring-out nozzle is formed in a branched manner from a top of a pouch body, wherein:

two symmetrical nozzle reinforcing areas are formed on both sides of a first protrusion as a result of a provision of the first protrusion at a central upper portion of the pouch front side member, extending from a center of the pouring-out nozzle backside portion to a central upper portion of the pouch body front side portion beyond a fold-back portion, and of a provision of two symmetrical second protrusions on both the sides of the first protrusion;

a third protrusion extending in a longitudinal direction of the nozzle is provided at a center of the pouring-out nozzle front side member; and a fourth protrusion is provided on an extension line from the third protrusion at a central upper portion of the pouch backside member, whereby the pouring-out nozzle can be fixed upright at a time of opening.

2. A branch type standing pouch according to claim 1, wherein a portion serving as a preformed opening line is provided at a leading end of the branched nozzle, the portion being subjected to processing for facilitating opening.

3. A branch type standing pouch according to claim 1, wherein, when the pouring-out nozzle is opened, lower ends of the first protrusion and the fourth protrusion reach at least an upper end surface of contents in the pouch.

4. A branch type standing pouch according to claim 1, wherein the nozzle reinforcing areas formed on the pouch front side member have triangular shapes which have apexes on the fold-back portion.

5. A branch type standing pouch according to claim 1, wherein the nozzle reinforcing areas formed on the pouch front side member have crescent shapes which have a maximum width at the fold-back portion.

6. A branch type standing pouch according to claim 1, wherein a height of a cross-section of each of the first protrusion, the second protrusions, the third protrusion, and the fourth protrusion is set to 0.5 to 5 mm, and a width thereof is set to 1 to 30 mm.

7. A branch type standing pouch according to claim 1, wherein auxiliary protrusions are provided below the nozzle reinforcing areas formed on the pouch front side member.

8. A branch type standing pouch according to claim 1, wherein an upper portion of the pouch body is narrowed so that squeezing portions are formed on both peripheral portions of the upper portion of the pouch body.

* * * * *